US008312816B2

(12) United States Patent
Vaccarella

(10) Patent No.: US 8,312,816 B2
(45) Date of Patent: Nov. 20, 2012

(54) CARRYING CASE WITH SELECTIVE OBJECT POSITIONING

(76) Inventor: Kimberlee Vaccarella, Ridgewood, NJ (US)

( * ) Notice: Subject to any disclaimer, the term of this patent is extended or adjusted under 35 U.S.C. 154(b) by 967 days.

(21) Appl. No.: 12/317,621

(22) Filed: Dec. 24, 2008

(65) Prior Publication Data

US 2009/0205759 A1 Aug. 20, 2009

Related U.S. Application Data

(63) Continuation-in-part of application No. 11/975,257, filed on Oct. 18, 2007, now Pat. No. 7,926,525.

(51) Int. Cl.
*A45C 13/40* (2006.01)

(52) U.S. Cl. ..... 105/106; 150/108; 150/104; 150/127; 190/102

(58) Field of Classification Search ..... 150/100, 150/103, 125, 126, 127, 107, 108, 106, 104; 383/103, 105; 411/339; 190/102, 101
See application file for complete search history.

(56) References Cited

U.S. PATENT DOCUMENTS

| | | | | |
|---|---|---|---|---|
| 2,023,457 | A * | 12/1935 | White | 24/114.7 |
| 2,421,067 | A * | 5/1947 | Howe | 383/92 |
| 2,797,605 | A | 7/1957 | Metze, Jr. et al. | |
| 3,009,381 | A * | 11/1961 | Rapata | 411/337 |
| 3,115,804 | A | 12/1963 | Johnson | |
| 3,180,385 | A | 4/1965 | Kuroda | |
| 3,867,971 | A * | 2/1975 | Hazan | 150/104 |
| 4,240,480 | A | 12/1980 | Strobel | |
| 4,344,240 | A * | 8/1982 | Schiller | 40/662 |
| D401,067 | S | 11/1998 | Hampshire | |
| 6,012,203 | A * | 1/2000 | Baron Pearson | 24/114.9 |
| 6,374,461 | B1 | 4/2002 | Gober et al. | |
| 7,607,461 | B2 | 10/2009 | Pace et al. | |
| 8,069,538 | B2 * | 12/2011 | Wilcox | 24/109 |
| 2004/0163297 | A1 * | 8/2004 | Lin | 40/640 |

FOREIGN PATENT DOCUMENTS

| | | | |
|---|---|---|---|
| JP | 2003-189921 | A | 7/2003 |
| JP | 2007-151822 | A | 6/2007 |

OTHER PUBLICATIONS

Office Action Issued Aug. 5, 2010 by the U.S. Patent Office in related U.S. Appl. No. 11/975,257 (7 pages).

* cited by examiner

*Primary Examiner* — Tri Mai
(74) *Attorney, Agent, or Firm* — Robert P. Michal; Lucas & Mercanti, LLP

(57) ABSTRACT

Handbag or carrying case includes a retaining compartment for retaining objects which is defined by structure having a plurality of apertures extending from the compartment to an exterior thereof, and at least one snap fastener which snaps into a respective aperture to thereby be secured to the compartment defining structure. An object may be coupled to the snap fastener such that the object is secured to the structure defining the compartment. The position of the object is variable depending on which aperture the snap fastener snaps into, with the user selecting where to locate the object by selecting the location at which the snap fastener connected thereto will engage with the compartment defining structure.

16 Claims, 6 Drawing Sheets

Figure 2
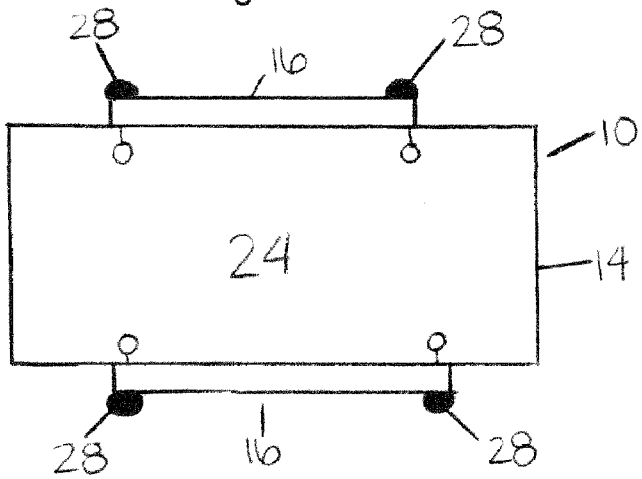
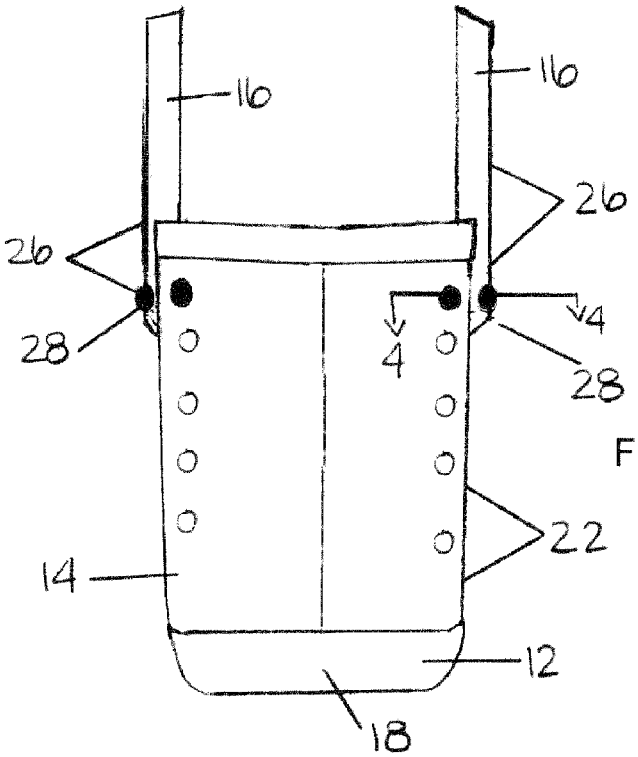
Figure 3
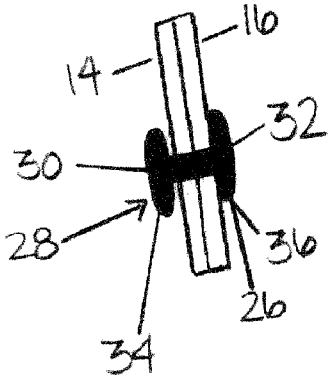
Figure 4

CARRYING CASE WITH SELECTIVE OBJECT POSITIONING

CROSS-REFERENCE TO RELATED APPLICATION

This application is a continuation-in-part of U.S. patent application Ser. No. 11/975,257 filed Oct. 18, 2007 now U.S. Pat. No. 7,926,525, the entire disclosure of which is incorporated herein by reference.

FIELD OF THE INVENTION

The present invention relates generally to a handbag or carrying case and more particularly to a handbag or carrying case which enables objects to be attached to a body of the carrying case in different positions.

Even more particularly, the present invention relates to a handbag or carrying case in which the same structure on a body of the handbag or carrying case enables variable attachment of straps which connect to objects and/or bags in which objects can be placed.

BACKGROUND OF THE INVENTION

Handbags or carrying cases are common everyday items used by both women and men to carry personal items. Such carrying cases are typically used to carry groceries from a supermarket, meals from take-out restaurants, sundries to and from the beach and so on.

A general form of a carrying case includes a body defining a retaining section and one or more straps coupled to the body. When different people use the carrying case, the straps often need to be adjusted for optimum use by that person.

Further, although carrying cases usually are produced in bulk, nowadays people want to personalize their possessions and thus different people may want to personalize a generic carrying case in a different manner, e.g., with different accessories.

It would therefore be desirable to provide a carrying case which enables adjustment of the straps and can be personalized with various accessories. As such, each person purchasing the carrying case would be able to position the strap in a desired position relative to the body and also customize or personalize the carrying case with different accessories.

Moreover, when using a carrying case, the user usually places different objects therein and then when they seek a particular object, they must search through the interior of the carrying case to find the particular object. It would therefore be desirable to provide a carrying case in which objects are attached to the carrying case and can be easily located without having to search through the entire interior of the carrying case.

OBJECTS AND SUMMARY OF THE INVENTION

It is an object of the present invention to provide a new and improved handbag or carrying case.

It is another object of the present invention to provide a new and improved handbag or carrying case which enables objects to be attached to a body of the carrying case in different positions.

In order to achieve at least one of these objects and possibly others, one embodiment of a handbag or carrying case in accordance with the invention, referred to hereinafter as a carrying case, includes a retaining compartment for retaining objects which is defined by structure having a plurality of apertures extending from the compartment to an exterior thereof, and at least one snap fastener arranged to snap into a respective aperture to thereby be secured to the structure defining the compartment. An object may be coupled to the snap fastener such that the object is secured to the structure defining the compartment. The position of the object is variable depending on which aperture the snap fastener snaps into, with the user selecting where to locate the object by selecting the location at which the snap fastener connected thereto will engage with the compartment defining structure.

Various snap fasteners may be used. In one embodiment, the snap fastener has first and second parts removably engageable with one another such that when engaged with each other through the respective aperture, the snap fastener is secured to compartment defining structure. The object is coupled to the first part of the snap fastener, and when retained inside the compartment defining structure, the second part is visible form the exterior and may be decorative and/or colored.

The object may be coupled to the snap fastener by a strap attached thereto and to the object such that the object is secured to the compartment defining structure via the strap and the snap fastener. The strap may be designed so that the object is removably attached thereto and thus different objects may be attached to the carrying case using the same strap.

Alternatively, the object may be coupled to the snap fastener by providing a bag defining a compartment in which the object is retainable and connecting the snap fastener to the bag. Depending on the size of the bag, two or three snap fasteners are connected to the bag.

In one embodiment, the structure defining the compartment includes a body having opposed sides and a plurality of apertures on each side.

A pair of elongate straps may be provided, each having opposite end regions and at least two apertures, one proximate each end region. Further, the carrying case may include snap fasteners arranged to attach the straps to the sides of the body via aligning pairs of apertures, i.e., one apertures on a side of the body and one aperture on the strap. To this end, the snap fasteners have two parts separable from one another such that the straps are removable from engagement with the body and positionable in different positions relative to the body. This provides for variable attachment of the straps to the body and therefore enables each user of the carrying case to position the straps as they desire.

In one embodiment, the body includes a base section defining a bottom of the compartment and a main body section including an annular portion defining the opposed sides. Apertures may be formed only in the main body section and not in the base section. Apertures may be formed in an orderly manner, e.g., in a plurality of substantially straight rows and in a plurality of substantially straight columns, on each side of the annular portion such that each row includes at least two apertures and each column includes at least two apertures. Each row may include any number of apertures, e.g., two to five, while each column may include any number of apertures, e.g., two to four.

While the presence of many apertures on the sides of the main body section enables variable attachment of the straps thereto, additional variability may be provided when the straps includes more than two apertures extending in a row in a longitudinal direction. In this case, the length of the strap between attachment points can be varied by appropriate selection of the apertures on the strap to align with the apertures on the main body section.

The first and second parts of the snap fastener may each include a flange arranged to prevent passage thereof through an aperture in the main body section. The second part may be colored and/or decorative, e.g., include a decoration on its outer side or face which will be visible during use of the carrying case. Since each user can select which decorative snap fastener they want to use to attach the straps to the main body section, the carrying case can be personalized with different accessories.

Such decorative snap fasteners can also be used for a purely ornamental purpose, i.e., inserted through an aperture in the man body section but not through an aperture in the strap. In this case, it emerges that the same apertures which are used to attach the straps to the main body section can also be used to personalize the carrying case and thus serve a dual purpose.

Colored snap fasteners, or at least snap fasteners with colored second parts which are designed to be visible from the exterior of the compartment, are useful to enable users to associate specific colors with particular objects so that they can know what is contained within their carrying case, without having to look therein, and also be able to easily retrieve a particular object if they know its associated color without having to search through the entire interior of the carrying case.

Any of the carrying cases described above can be used in a kit which enables easy construction of multiple and different carrying cases.

Such a kit would include the carrying case with a first part of a snap fastener and a plurality of second parts of the snap fastener, each second part having a different color to thereby enable association of the color thereof with an object retained in the compartment. One or more straps or bags would also be provided to enable the objects to be attached to the first part of the snap fastener, e.g., multiple straps each with a first part, or multiple bags each having one or more first parts connected thereto. The kit might also include three or more straps which are different from one another with respect to size, color and/or style. Such straps may also have a different color than the color of the body of the carrying case. Such a kit could also include a plurality of different decorative snap fasteners. As such, many different combinations of decorative snap fasteners and straps could be connected to the body to thereby enable formation of visually distinct carrying cases from the same kit.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 2 is a top view of the carrying case shown in FIG. 1;

FIG. 3 is a side view of the carrying case shown in FIG. 1;

FIG. 4 is a cross-sectional view taken along the line 4-4 of FIG. 3;

DETAILED DESCRIPTION OF THE INVENTION

Figure 1:
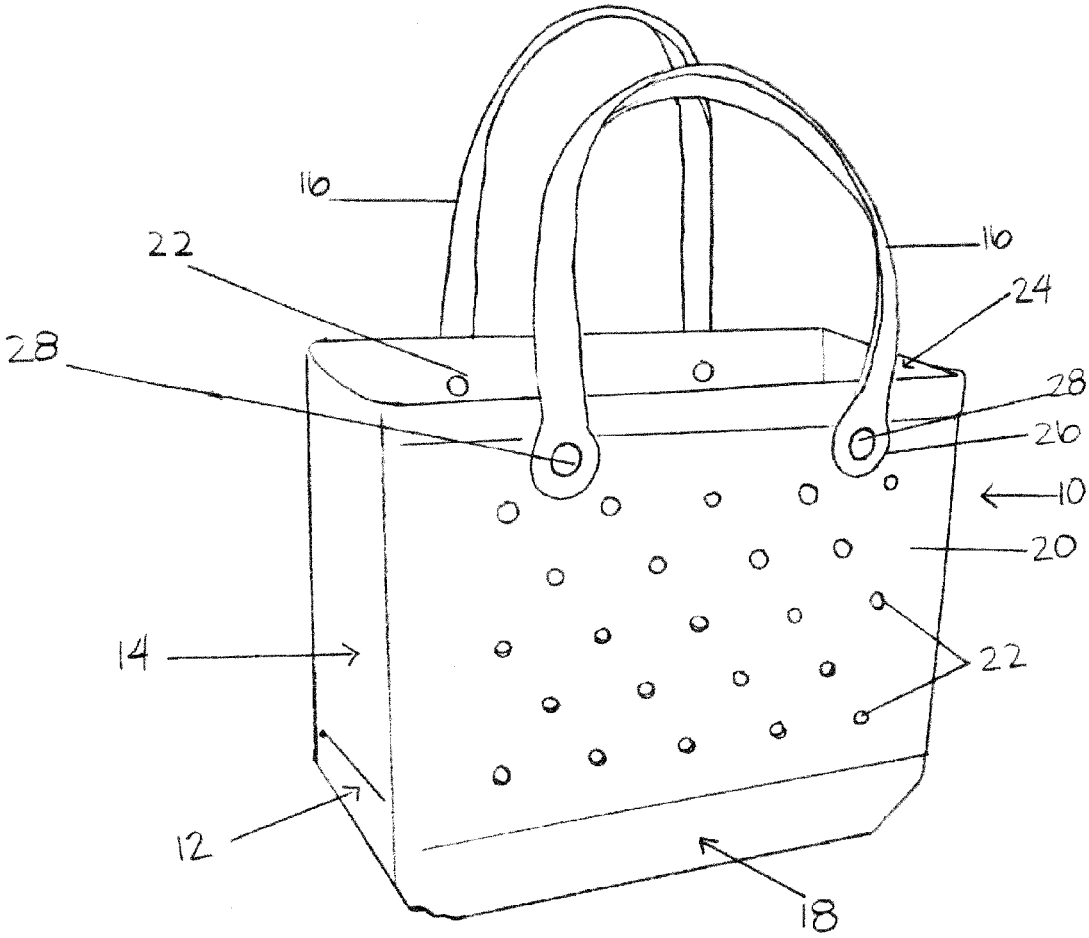
FIG. 1 is a perspective view of a carrying case in accordance with the invention.

Referring the accompanying drawings wherein like reference numerals refer to the same or similar elements, a carrying case in accordance with the invention is shown in FIGS. 1-4 and designated generally as 10 and comprises a base section 12, a main body section 14 and a pair of straps 16.

Base section 12 and main body section 14 may be formed integral and/or monolithic with one another and/or formed as a unitary body, or as separate parts which are attached together. When formed as an integral, monolithic and/or unitary structure, the shape and/or form of the combined base section 12 and main body section 14 may vary and includes, but is not limited to, those currently used for carrying cases, such as a box-shaped carrying case, a sack-type carrying case, a bucket-type carrying case, a waist-band-type carrying case, a saddle-type carrying case, a diaper bag, a backpack, and a girl's bag.

Base section 12 may be made of a solid, non-perforated material which is flexible or rigid. For example, base section 12 may be made from the foam resin "croslite", a type of ethylene vinyl acetate. Otherwise, the base section 12 may be made from a lightweight antimicrobial material.

As shown, base section 12 is made of a slightly rigid material to provide the lower portion of the carrying case 10 with a rigid form. The lower surface 18 of the base section 12 can be formed with an imprint or form similar to a sole of a clog. Additionally or alternatively, the edges of the base section 12 can be provided with sole grips.

Main body section 14 includes an annular portion 20 having a plurality of apertures 22 therein. Apertures 22 may be arranged in substantially straight rows and columns as shown, with any number of columns, e.g., from two to ten and possibly at least four, and any number of rows, e.g., from two to ten and possibly at least four, or in a random arrangement. One full side of the annular portion 20 is shown in FIG. 1 and includes five rows of between three and five apertures 22 each.

Apertures 22 may be provided along the entire surface of the annular portion 20 or along only one or more discrete, localized portions thereof. The size and shape of the apertures 22 can vary as desired, with all apertures 22 possibly having the same or a substantially similar size and/or shape. A carrying case in accordance with the invention may therefore include any number of apertures, arranged at any locations whether in an orderly or random arrangement, having any desired size or sizes, and having any desired shape or shapes.

Apertures 22 may be formed by perforating an initially solid strip of material, or a strip of material could be formed to initially include apertures, and which strip is then manipulated into the annular shape shown clearly in FIG. 2.

Annular portion 20 may be made from a flexible or rigid material. For example, annular portion 20 may be made from the foam resin "croslite", a type of ethylene vinyl acetate. Otherwise, the annular portion 20 may be made from a lightweight antimicrobial material.

There are virtually no limitations on the placement of apertures 22 on the annular portion 20. One minor limitation is that the annular portion 20 should provide a sufficiently sturdy connection between the location at which the straps 16 are attached and the base section 12 to enable a retaining compartment 24 defined by the base section 12 and main body section 14 to usefully retain objects. The retaining compartment 24 is not limited to being formed by the base section 12 and main body section 14 and may be formed by other sections or constructions. Generally, carrying case 10 in accordance with the invention includes a body or any other structure which defines a retaining compartment having opposed sides connected to one another, with apertures on each side.

Straps 16 may be removably attached to the main body section 14 or fixedly or permanently attached to the main body section 14. In particular, for larger carrying cases, it would be better to fix the straps 16 to the main body section 14 to avoid inadvertent detachment of the straps 16 from the main body section 14.

Referring to FIG. 3 wherein the straps 16 are removable from the main body section 14, each strap 16 includes apertures 26 and is attached to the annular portion 20 of the main body section 14 via snap fasteners 28 which snap together through an aligning pair of apertures 22, 26, i.e., an aperture 26 on the strap 16 is aligned with an aperture 22 on the annular portion 20 and a snap fastener 28 is snap together therethrough. Straps 16 are attached on opposed or opposite sides of the annular portion 20 and preferably in alignment with one another so that the person using the carrying case 10 can easily grasp both straps 16.

Each strap 16 may include a single aperture 26 proximate each end region, i.e., only two apertures, or more than two apertures 26 extending in a row in a longitudinal direction of the strap 16. In this case, at least some of the apertures 26 are preferably situated proximate the opposite end regions of the straps 16.

Straps 16 may be made from a flexible or rigid material. For example, straps 16 may be made from the foam resin "croslite", a type of ethylene vinyl acetate. Otherwise, the straps 16 may be made from a lightweight antimicrobial material.

In some embodiments of the invention, the straps 16 do not have to be attached to annular portion 20 of the carrying case 10 via snap fasteners 28 passing through apertures 22, 26. Rather, the straps 16 may be attached to the annular portion 20 of the carrying case 10 using other connecting arrangements or fixed to or formed integral with the annular portion 20.

Each snap fastener 28 has two parts 30, 32 with part 30 being an inner part which has a flange 34 alongside the inner surface of the annular portion 20 and part 32 having a flange 36 alongside the outer surface of a strap 16 (see FIG. 4). Flange 34 has a size and shape which prevents it from passing through an aperture 22 in the annular portion 20 while flange 36 has a size and shape which prevents it from passing through an aperture 26 in the strap 16.

In view of the placement of multiple apertures 22 in the annular portion 20 of the main body section 14, and also possibly when more than two apertures 26 are arranged in the straps 16, and the use of snap fasteners 28 to attach the straps 16 to the annular portion 20 of the main body section 14, attachment of the straps 16 to the main body section 14 can be varied as desired to provide an optimum fit and/or desired appearance for the user of the carrying case 10. That is, the user can select apertures 22 of the annular portion 20 of the main body section 14 to align with the apertures 26 on the strap 16 and then snap the snap fasteners 28 through the aligning pairs of apertures 22, 26. If the strap 16 is not in a desired position relative to the main body section 14 or subsequently it is desired to change the relative position between the strap 16 and the main body section 14, the snap fastener 28 is opened and the strap 16 is moved until apertures 26 therein align with one or more different apertures 22 in the main body section 14.

Accordingly, by providing multiple apertures 22 in the annular portion 20 of the main body section 14, it becomes possible to enable variable relative positioning of the straps 16 on the main body section 14. The variations in the positioning of the straps 16 relative to the main body section 14 can further be increased when the straps 16 themselves include more than two apertures 26 and/or have an adjustable length.

Snap fasteners 28 may be substituted for by any type of two-part fastener. Preferably, to maintain the adjustability feature of the straps 16, the snap fasteners 28 should be of a type wherein one part is detachable from the other.

The size of the carrying case 10 may vary as desired. In one embodiment, the carrying case 10 has a length of about 13.5 inches, a height of about 9.5 inches and a depth of about 6 inches. The base section 12 is about 8.5 inches long. In another embodiment, the carrying case 10 has a length of about 17 inches, a height of about 13 inches and a depth of about 6.5 inches. The base section 12 is about 11.5 inches long. In yet another embodiment, the carrying case 10 has a length of about 22.5 inches, a height of about 17 inches and a depth of about 9.5 inches. The base section 12 is about 14.5 inches long. In yet another embodiment, the carrying case 10 has a length of about 26 inches, a height of about 17.5 inches and a depth of about 10 inches. The base section 12 is about 17 inches long. In any of these embodiments, the height of the base section 12 and the height of the main body section 14 may be selected as desired.

The color of the carrying case 10 may also vary as desired. In some embodiments, the base section 12 and main body section 14 have the same color while the straps 16 have a different color. However, the base section 12 and main body section 14 may be different colors, different from one another and optionally also different than the color of the straps 16. The straps 16 themselves may have different colors.

Furthermore, a carrying case 10 may be sold in a kit with multiple straps 16, in different colors, sizes (lengths) and/or styles (overall design). Thus, an exemplifying kit including a carrying case 10 in accordance with the invention would include not only a body forming an object-retaining compartment such as described above but would also include a minimum of three straps, at least one of which is different than the other two. This allows for variations in the selection of two of these three straps for attachment to the carrying case. Another embodiment of a kit could include a plurality of pairs of identical straps, e.g., two blue straps, two red straps and two green straps, so that each pair could be used independently and different carrying cases formed. Straps could also be sold separately from the kits to enable users to subsequently purchase additional straps. Also, different bodies of the carrying case, i.e., the base section 12 and the main body section 14, can be sold separately so that users can separately purchase one or more bodies and straps and create whatever combinations of bodies and straps they want.

In one embodiment, decorative snap fasteners known as JIBBITZ™ may be used in a similar manner as they are used in connection with footwear sold under the tradename CROCS™ by Crocs, Inc., with the decorative part of the snap fastener facing outward. In one embodiment, the apertures 22, 26 all have a common or substantially similar size which enable such decorative snap fasteners to be used. Moreover, the straps 16 themselves may be the ankle straps as used on the footwear sold under the tradename CROCS™. In one particular embodiment, large JIBBITZ™ are used and apertures 22 and/or apertures 26 dimensioned accordingly.

Using such JIBBITZ™, or other decorative snap fasteners, whether functionally to attach the straps 16 to the main body section 14 or simply as decorations on the main body section 14 and/or straps 16, a user can accessorize and personalize their carrying case 10 in whatever manner they see fit, limited only by the availability of decorative snap fasteners or materials for creating such decorative snap fasteners. Use of such decorative snap fasteners does not damage the carrying case 10 because they snap into or pass through apertures 22 in the main body section 14 and/or apertures 26 in the straps 16.

Moreover, it can be seen that the same structure which enables variable attachment of straps 16, i.e., apertures 22 cooperating with apertures 26 on the straps 16, also enables placement of decorative snap fasteners 28. The presence of unused apertures 22 on the main body section 14 and apertures 26 on the straps 16 therefore enables attachment of purely decorative snap fasteners 28.

In some embodiments, all of the elements of the carrying case 10 are made of foam material, such as "croslite" which is the same material as used in the footwear sold under the tradename CROCS™ and other similar materials, while in others, all of the elements are made of leather. It should be understood that the selection of the materials of the components of the carrying case 10 is not limited to foam material or leather and may be any single material or combination of materials.

Moreover, graphics may be formed on the base section 12 and/or main body section 14. Such graphics may include fictional characters, trademarks, names, slogans, etc.

Figure 5:
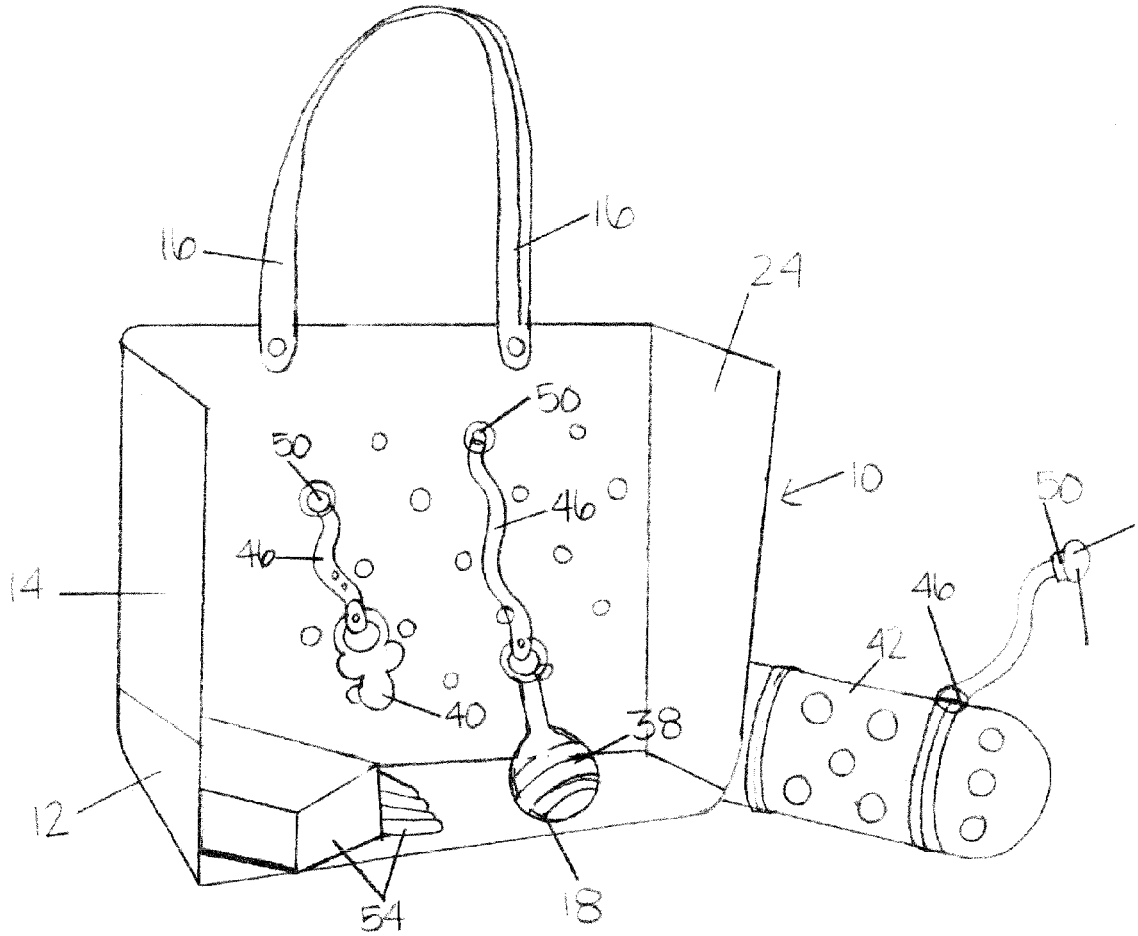
FIG. 5 is a view of the interior of a carrying case similar to the one shown in FIG. 1.
Figure 6:
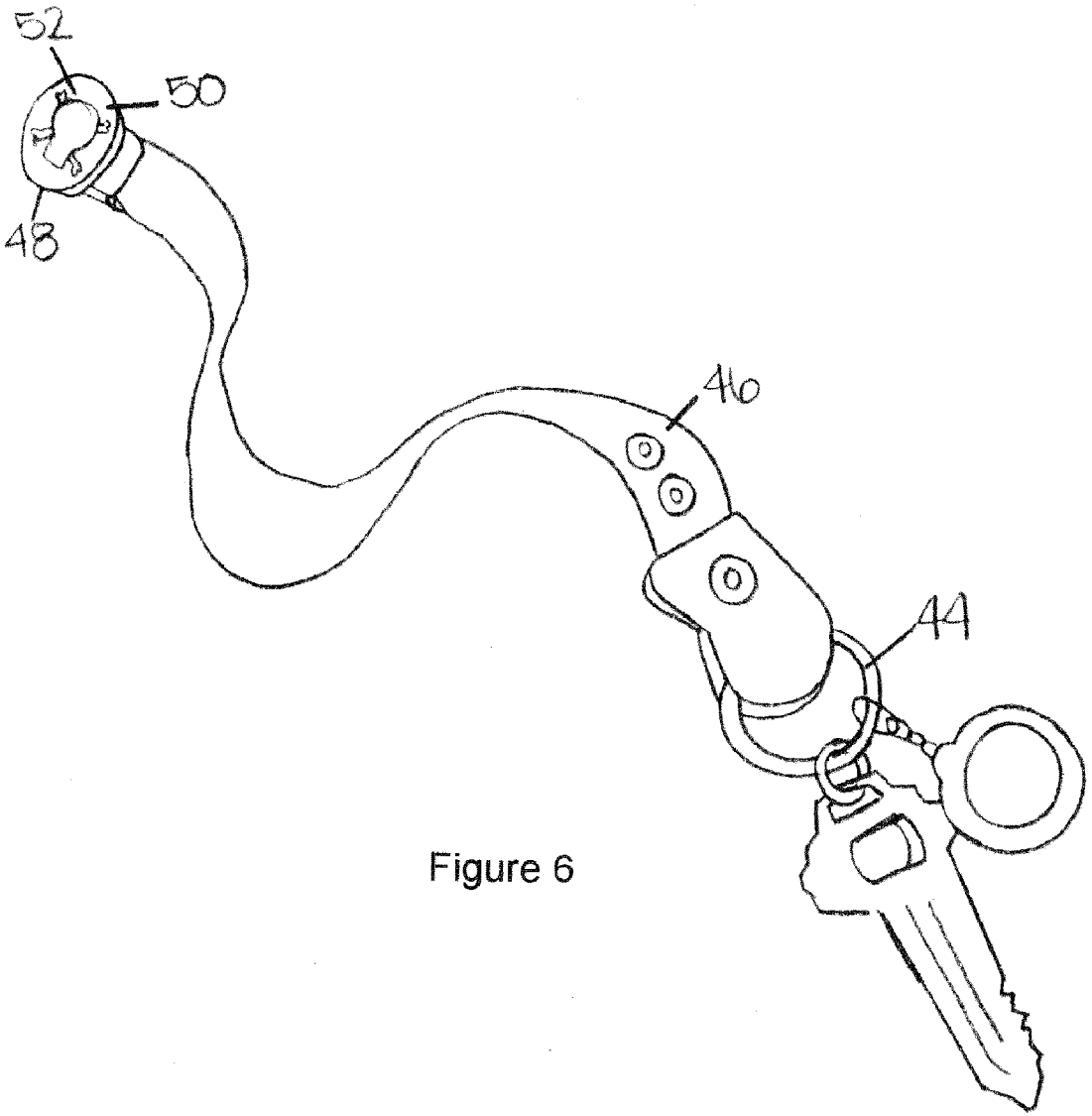
FIG. 6 is a perspective view of one embodiment of an object coupling structure for use with the carrying case in accordance with the invention.

Instead of attaching decorative snap fasteners to the annular portion 20, it is alternatively or additionally possible to attach or couple objects 38, 40, 42, 44 to the annular portion 20 by means of a coupling structure which couples the object to annular portion 20 of the carrying case 10. As shown in FIGS. 5 and 6, one embodiment of the coupling structure may be a strap 46 and a snap fastener 48. Each snap fastener 48 has two parts 50, 52 (see FIG. 6) with a first part 50 being an inner part which has a flange positionable alongside the inner surface of the annular portion 20 and a second part 52 having a flange positionable alongside the outer surface of the annular portion 20 when the snap fastener 48 is attached to the annular portion 20. The strap 46 is connected to the first part 50 using any conventional connection technique. Each flange has a size and shape which prevents it from passing through an aperture 22 in the annular portion 20.

As shown in FIGS. 5 and 6, different objects can be coupled or attached to the carrying case 10 depending on the user's needs. FIG. 5 shows objects related to childcare including a rattle 38, a pacifier 40 and a rolled changing pad 42, whereby the retaining compartment 24 in the carrying case 10 could likely include diapers and wipes 54. FIG. 6 shows a key chain 44 attached to the strap 46. Strap 46 may be provided with a snap fastener arrangement at the end opposite the snap fastener 48 to enable different objects, e.g., the rattle 38, pacifier 40, changing pad 42 and key chain 44, to be selectively attached to the strap 46.

The foregoing are only examples of types of objects that can be attached to the strap 46 with the strap 46 also being attached to the annular portion 20 of the carrying case 10, and there is virtually no limitation on the types of objects that can be used in accordance with the invention. The main limitation is the space constraint on the volume of space of the retaining compartment 24 in the carrying case 10. Thus, each user of the carrying case 10 can attach any personal items they want to the carrying case 10 by attaching a strap 46 with a snap fastener 48 at one end to each item and attaching the snap fastener 48 to an aperture 22 in the annular portion 20 of the carrying case 10.

An advantage of providing a strap 46 to enable attachment of different objects to the carrying case 10 is that user can optimally position the objects anywhere they want about the carrying case 10 where there are apertures 22. The user could position all of the objects along one side of the carrying case 10, or intersperse the objects along both sides of the carrying case 10. The user could position heavier or larger objects at the bottom of the carrying case 10 and lighter objects at the top of the carrying case 10, or more frequently used objects at the top of the carrying case 10 and less frequently used objects at the bottom of the carrying case 10. Moreover, although FIG. 5 shows the objects in the compartment 24 in the interior of the carrying case 10, it is also possible to attach the straps 46 to the carrying case 10 such that the objects are exterior of the carrying case 10. Placement of the objects is limited only by the locations where apertures 22 are formed.

In one embodiment, the parts 52 of the snap fasteners 48 which are designed to be visible from the exterior of the carrying case 10 are colored in different colors, with the colored parts 52 of the snap fasteners 48 being included in a kit. This enables the user to select a particular color and associate that color with a particular object. For example, the user could select a pink part 52 and attach the pink part 52 to a corresponding part 50 of the snap fastener 48 connected to the strap 46 having a pacifier 40 attached thereto, with the snap fastener 48 extending through an aperture 22 while the pacifier 40 is in the compartment 24. Then, when the user wants to retrieve the pacifier 40, they would only have to locate the pink part 52 and would quickly retrieve the pacifier 40 without having to dig through the compartment 24.

Another advantage of associating colors of the second, visible parts 52 of the snap fasteners 48 with objects, and being able to view the colors of the parts 52, is that the user would know what objects they have in the carrying case 10 without having to open the carrying case 10. Applying the example above, if the user sees a pink second part 52, then they know they have a pacifier 40 in the carrying case 10 and do not have to open the carrying case 10.

Figure 7:
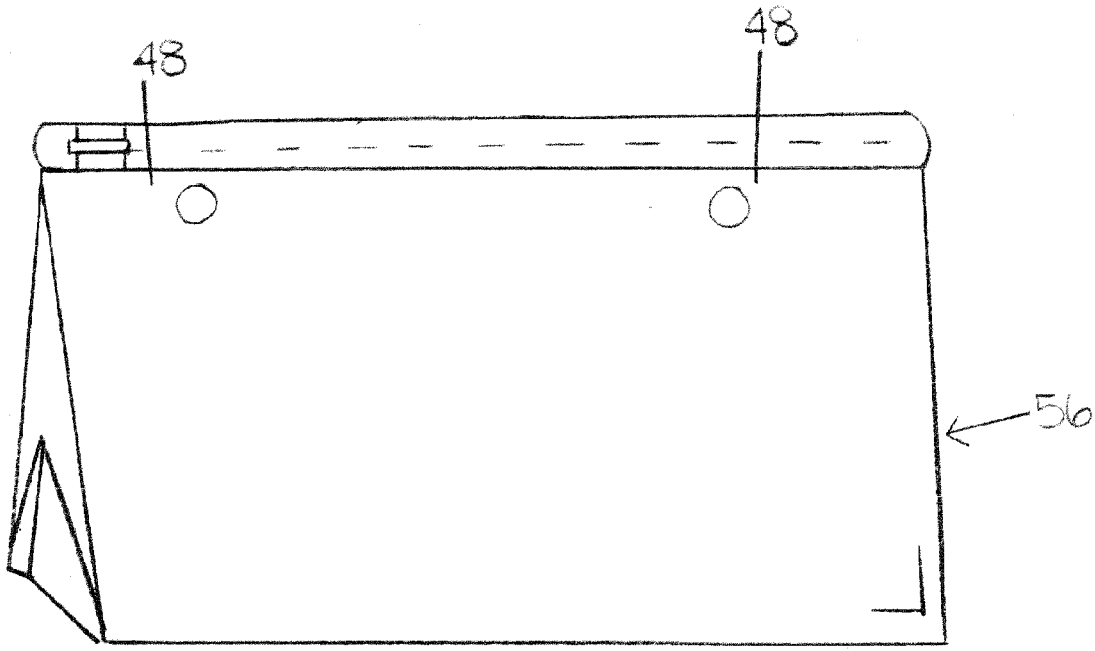
FIG. 7 is a front view of a first embodiment of a bag attachment for the carrying case in accordance with the invention.
Figure 8:
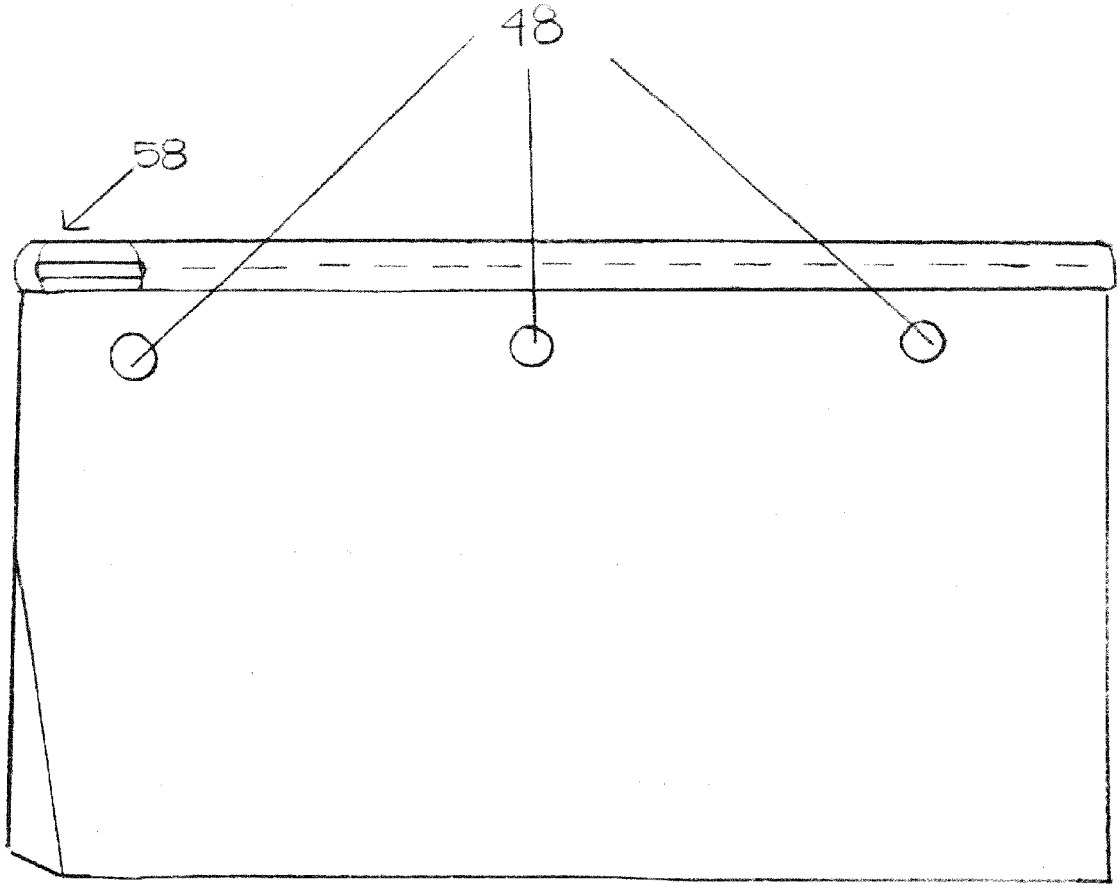
FIG. 8 is a front view of a second embodiment of a bag attachment for the carrying case in accordance with the invention.

Another way to couple objects to the carrying case 10 via the apertures 22 is by providing a bag 56, 58 as shown in FIGS. 7 and 8. Bag 56 is formed as a conventional bag with opposed material portions defining a retaining compartment and a zipper or other means to access the compartment, and additionally includes two snap fasteners 48. Snap fasteners 48 are spaced apart a distance which is substantially the same as the distance between multiple pairs of apertures 22 on the annular portion 20 of the carrying case 10 to enable easy attachment of the bag 56 to the carrying case 10.

Similarly, bag 58 is also formed as a conventional bag with opposed material portions defining a retaining compartment and a zipper or other means to access the compartment, and additionally includes three snap fasteners 48. Snap fasteners 48 are spaced apart substantially the same as the spacing between sets of three apertures 22 on the annular portion 20 of the carrying case 10 to enable easy attachment of the bag 58 to the carrying case 10.

Bag 58 is larger than bag 56 and therefore includes three snap fasteners 48 instead of two since additional support may be required in view of the larger capacity of the retaining compartment in bag 58 in comparison to bag 56. It is envisioned though that a bag with any a number of snap fasteners 48 may be provided with one part of the snap fastener 48 being connected to the bag and the other part removable therefrom to enable the bag to be selectively positioned as desired along the annular portion 20 of the carrying case 10 (whether inside or outside of the carrying case 10). The fixed part of the snap fastener 48 may be fixed to the bag 56, 58 in any conventional manner while the removable part of the snap fastener 48 may be colored and/or decorative as described above.

Using bags 56, 58, individual objects do not have to be attached to straps 46 which are attached to the carrying case 10. Instead, the objects are coupled to the carrying case 10 via their placement in a bag 56, 58 which is attached to the carrying case 10. As such, bags 56, 58 are useful for objects that cannot be attached to straps, such as garments, towels, money, coins and communication devices as shown in FIGS. 7 and 8.

Bags 56, 58 may be manufactured in various sizes and colors and from various materials, including transparent and/or opaque materials.

In an embodiment wherein a kit includes the carrying case 10, one or more straps 46 and/or bags 56, 58 for coupling objects thereto and colored parts 52 of snap fasteners 48, the carrying case 10 may have alternative forms other than that shown in the drawings. For example, the carrying case 10 may be formed without straps 16.

In some embodiments of the invention, one-piece accessories may be inserted into the apertures 22 to accessorize the carrying case 10. One form of such one-piece accessories has a spool-shape with a larger end adapted to be positioned on the outside of the carrying case 10 (and may thus be decorative) and a smaller end adapted to be positioned on the inside of the carrying case 10 to act as a lip to hold the accessory in place. This same form may be used to attach the straps 16 to the main body section 14 via apertures 22 (as in the embodiment shown in FIGS. 1-4), and to attach the straps 46 to the main body section 14 the apertures 26 (as in the embodiment shown in FIGS. 5 and 6) and to attach the bas 56, 58 to the main body section 14 as shown in FIGS. 7 and 8). Thus, this type of fastener would not be a two-piece snap fastener but would still snap into the main body section 14 through an aperture 22 thereon and retain the strap 16, strap 46 or bags 56, 58 in connection with the main body section 14. Other one-piece snap fasteners may also be used in accordance with the invention.

While particular embodiments of the invention has been shown and described, it will be obvious to those skilled in the art that changes and modifications may be made without departing from the invention in its broader aspects, and, therefore, the aim of this application is to cover all such changes and modifications as fall within the true spirit and scope of the invention.

The invention claimed is:

1. A carrying case, comprising:

compartment defining means for defining a retaining compartment for retaining objects, said compartment defining means including a plurality of apertures extending from said retaining compartment to an exterior of said compartment defining means;

at least one snap fastener arranged to snap into a respective one of said apertures to thereby be secured to said compartment defining means; and coupling means comprising at least a strap for coupling an object to said at least one snap fastener such that the object is secured to said compartment defining means via said coupling means and the position of the object is variable depending on which of said apertures said snap fastener engages, said strap having one end being unattached to said case.

2. The carrying case of claim 1, wherein each of said at least one snap fastener has first and second parts removably engageable with one another such that when engaged with each other through the respective one of said apertures, said snap fastener is secured to said compartment defining means, said coupling means coupling the object to said first part of said at least one snap fastener.

3. The carrying case of claim 2, wherein said first part of said snap fastener has a flange arranged to prevent passage of said first part through the respective one of said apertures in said compartment defining means and said second part has a flange arranged to prevent passage of said second part through said respective aperture in said compartment defining means.

4. The carrying case of claim 2, wherein said second part is colored.

5. The carrying case of claim 1, wherein said at least one strap each attached to a respective one of said at least one snap fastener and arranged to attach to the object such that the object is secured to said compartment defining means via said strap and said snap fastener.

6. The carrying case of claim 5, wherein said at least one strap is arranged to removably attach to the object.

7. The carrying case of claim 1, further comprising:

a pair of elongate straps, each of said elongate straps having opposite end regions and at least two apertures, one proximate each of said end regions; and snap fasteners arranged to attach said elongate straps to said opposed sides via aligning pairs of one of said apertures on said opposed sides and one of said apertures on said elongate straps, said snap fasteners being arranged to enable said elongate straps to be removable from engagement with said compartment defining means and positionable in different positions relative to said compartment defining means.

8. The carrying case of claim 1, wherein said compartment defining means comprise a base section defining a bottom of said compartment and a main body section including an annular portion, said apertures being formed on said annular portion.

9. A carrying case, comprising:

compartment defining means for defining a retaining compartment for retaining objects, said compartment defining means including a plurality of apertures extending from said retaining compartment to an exterior of said compartment defining means; and object attachment means for attaching an object to said compartment defining means in variable and different positions, each of said object attachment means comprising:

a snap fastener arranged to snap into a respective one of said apertures to thereby be secured to said compartment defining means; and coupling means comprising a strap for coupling an object to said snap fastener such that the object is secured to said compartment defining means via said coupling means and the position of the object is variable depending on which of said apertures said snap fastener engages, said strap having one end being unattached to said case.

10. The carrying case of claim 9, wherein said a strap attached to said snap fastener and arranged to attach to the object such that the object is secured to said compartment defining means via said strap and said snap fastener.

11. The carrying case of claim 10, wherein said strap is arranged to removably attach to the object.

12. The carrying case of claim 9, wherein said snap fastener has first and second parts removably engageable with one another such that when engaged with each other through the respective one of said apertures, said snap fastener is secured to said compartment defining means, said coupling means coupling the object to said first part of said at least one snap fastener.

13. The carrying case of claim 12, wherein said first part of said snap fastener has a flange arranged to prevent passage of said first part through the respective one of said apertures in said compartment defining means and said second part has a flange arranged to prevent passage of said second part through said respective aperture in said compartment defining means.

14. The carrying case of claim 12, wherein said second part is colored.

15. A kit which enables color-designation of objects for a carrying case, comprising:

compartment defining means for defining a retaining compartment for retaining objects, said compartment defining means including a plurality of apertures extending from said retaining compartment to an exterior of said compartment defining means;

a first part of a snap fastener;

a plurality of second parts of said snap fastener, said first part and each of said second parts being removably engageable with one another with said first part facing the interior of said compartment defining means and said second part facing the exterior of said compartment defining means such that when engaged with each other through one of said apertures, said snap fastener is secured to said compartment defining means; and coupling means comprising a strap for coupling an object to said first part of said snap fastener such that the object is secured to said compartment defining means via said coupling means and the position of the object is variable depending on which of said apertures said snap fastener passes through, said strap having one end being unattached to said case, each of said second parts of said snap fastener having a different color to thereby enable association of a color of said second part of said snap fastener visible from the exterior of said compartment defining means with the object retained in said compartment.

16. The kit of claim 15, wherein said strap attached to said first part of said snap fastener and arranged to attach to the object such that the object is secured to said compartment defining means via said strap and said snap fastener.

* * * * *